United States Patent [19]

Takahashi et al.

[11] Patent Number: 4,951,622

[45] Date of Patent: Aug. 28, 1990

[54] CYLINDER HEAD FOR DOHC INTERNAL COMBUSTION ENGINE WITH FOUR VALVES PER CYLINDER

[75] Inventors: Yoshio Takahashi; Takashi Yanagisawa; Eiichi Fujisawa, all of Yokohama, Japan

[73] Assignee: Nissan Motor Co., Ltd., Yokohama, Japan

[21] Appl. No.: 313,424

[22] Filed: Feb. 22, 1989

[30] Foreign Application Priority Data

Feb. 22, 1988 [JP] Japan ..... 63-22068

[51] Int. Cl.[5] ..... F01M 1/00

[52] U.S. Cl. ..... 123/193 H; 123/196 R; 123/90.4

[58] Field of Search ..... 123/193 H, 90.27, 90.33, 123/90.4, 196 R

[56] References Cited

U.S. PATENT DOCUMENTS

| | | | |
|---|---|---|---|
| 4,537,165 | 8/1985 | Honda et al. | 123/90.27 |
| 4,630,580 | 12/1986 | Sawaki et al. | 123/90.33 |
| 4,649,873 | 3/1987 | Amano | 123/193 H |
| 4,699,092 | 10/1987 | Ruf et al. | 123/193 H |
| 4,709,667 | 12/1987 | Ichihara et al. | 123/90.27 |
| 4,791,893 | 12/1988 | Muranaka et al. | 123/90.4 |
| 4,819,591 | 4/1989 | Valentine | 123/90.4 |
| 4,825,822 | 5/1987 | Muranaka et al. | 123/90.4 |

*Primary Examiner*—Andrew M. Dolinar
*Assistant Examiner*—M. Macy
*Attorney, Agent, or Firm*—Pennie & Edmonds

[57] ABSTRACT

In a cylinder head for a DOHC internal combustion engine of the type having four valves per cylinder, a thin, flat recess is formed in the wall above an upper deck in such a way as to communicate an oil supply passage and an upper side of the upper deck. An oil return passage is provided adjacent a head bolt hole for providing communication between the recess and a lower side of a lower deck so that oil having lubricated parts and portions of the engine flows down to the upper side of the upper deck from which it is conducted to the lower side of the lower deck through the recess and the oil return passage. From the lower side of the lower deck, oil is returned to an oil pan by way of a cylinder block.

10 Claims, 5 Drawing Sheets

CYLINDER HEAD FOR DOHC INTERNAL COMBUSTION ENGINE WITH FOUR VALVES PER CYLINDER

BACKGROUND OF THE INVENTION

1. Field of the Invention

The present invention relates to a cylinder head for a DOHC internal combustion engine of the kind having four valves per cylinder.

2. Description of the Prior Art

It is a known DOHC internal combustion engine that has two intake valves and two exhaust valves per cylinder. The intake valves and the exhaust valves are driven by two independent camshafts installed on a cylinder head.

An internal combustion engine is constructed so as to draw lubricating oil from an oil pan and supply it to a valve drive train, etc. for lubrication of same.

The internal combustion engine of the above described kind has a difficulty in forming an oil passage in the cylinder head due to the complicated structure of the valve drive train and the cylinder head. For example, in a certain case an oil supply passage can be formed in the cylinder head in such a way as to penetrate therethrough but an oil return passage cannot in the similar manner.

For this reason, no oil return passage has heretofore been formed in the cylinder head for the engine of the above described kind so that the oil having lubricated the valve drive train, etc. flows from an upper deck of the cylinder head down to a camshaft drive chain chamber from which it drops into the oil pan. However, since the upper the deck is far apart from the camshaft drive chain chamber, there is a difficulty of rapidly and assuredly returning lubricating oil to the oil pan and therefore there is a possibility of stagnation of lubricating oil and therefore a lack of same.

Further, some internal combustion engines of the above described kind are constructed so that movement of cams of a camshaft is transmitted to intake and exhaust valves by way of rocker arms of the end pivot type, i.e., of the type adapted to pivot at one end. When this is the case, each valve is driven by an independent rocker arm, resulting in an increased number of constituent parts as lash adjusters, etc. and an increased number of portions to be lubricated. Accordingly, a further complicated structre of a cylinder head results as disclosed in Japanese provisional patent publication No. 60-79141.

SUMMARY OF THE INVENTION

In accordance with the present invention, there is provided an improved cylinder head for a DOHC internal combustion engine of the type having four valves per cylinder. The cylinder head comprises a combustion chamber, two intake valve openings and two exhaust valve openings communicating with the combustion chamber, two intake ports and two exhaust ports communicating with the intake valve openings and the exhaust valve openings, respectively, two first supporting portions for slidably supporting two intake valves which open and close the intake valve openings, two second supporting portions for slidably supporting two exhaust valves which open and close the exhaust valve openings, a plurality of bearing portions for rotatably supporting thereon two camshafts for driving the intake valves and the exhaust valves, independently, two third supporting portions for respectively supporting Y-shaped rocker arms for driving said two intake valves and said two exhaust valves, independently, the third supporting portions being located outside of the axes of said camshaft, a lower deck, a plurality of head bolt holes under the bearing portions and extending through the lower deck to open to a lower side of the lower deck, an upper deck, a recess adjacent one of the head bolt holes and communicating with an upper side of the upper deck and an oil return passage in parallel with the head bolt holes and providing communication between the recess and the lower side of the lower deck.

This structure is effective for solving the above noted problems inherent in the prior art cylinder head.

It is accordingly an object of the present invention to provide an improved cylinder head for a DOHC internal combustion engine which can assuredly and rapidly return oil to an oil pan after lubrication of various parts and portions of the engine.

It is another object of the present invention to provide an improved cylinder head of the above described character which can assuredly prevent stagnation of oil in some places of the cylinder head and thereby maintain a good lubricating condition of the engine.

It is a further object of the present invention to provide a cylinder head of the above described character which is advantageous from the point of view of the number of constituent parts and therefore the cost.

It is a further object of the present invention to provide a cylinder head of the above described character which can improve the productivity and therefore can reduce the manufacturing cost.

DESCRIPTION OF THE PREFERRED EMBODIMENT

Figure 1:
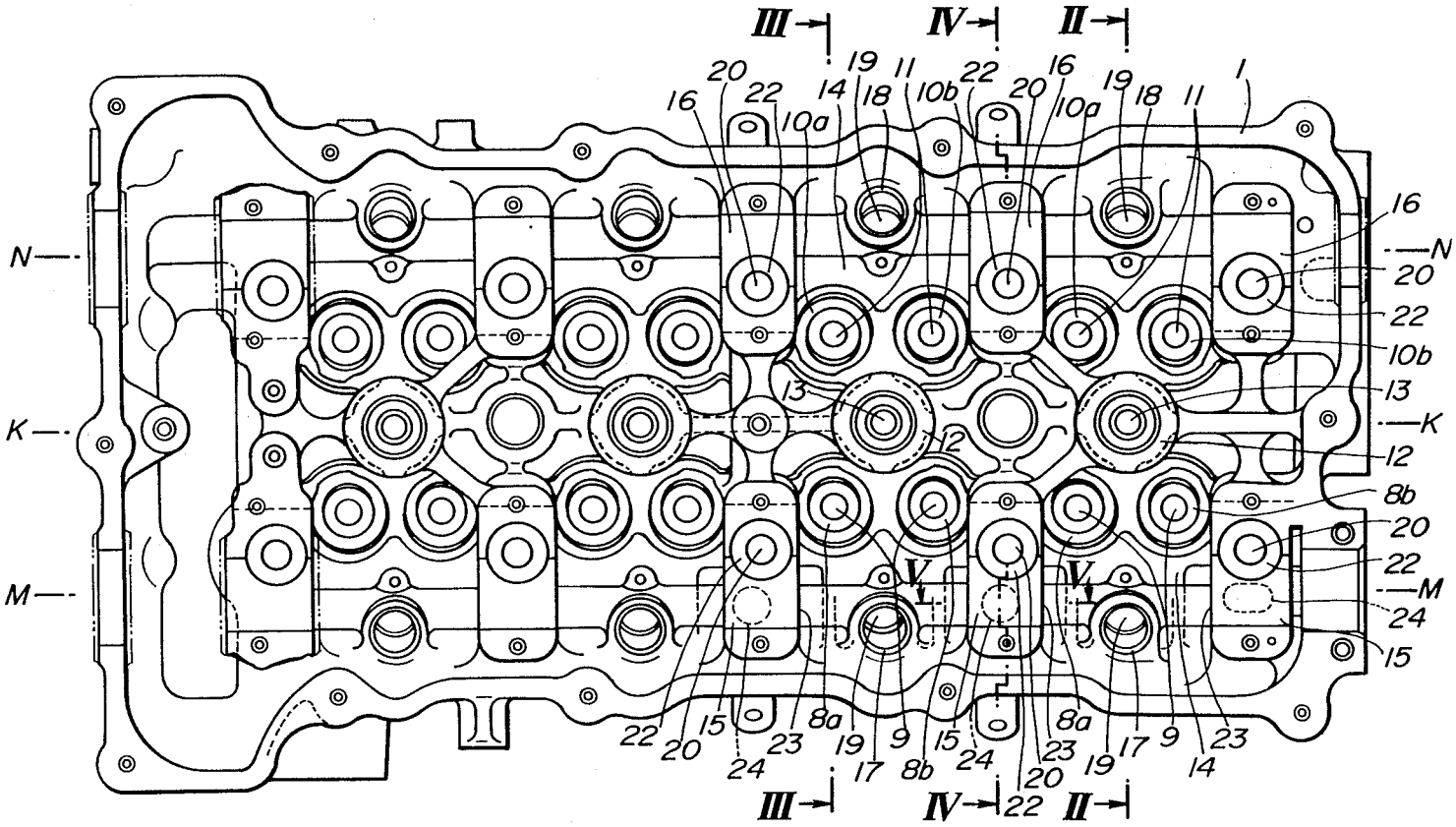
FIG. 1 is a top plan view of a cylinder head according to an embodiment of the present invention.
Figure 2:
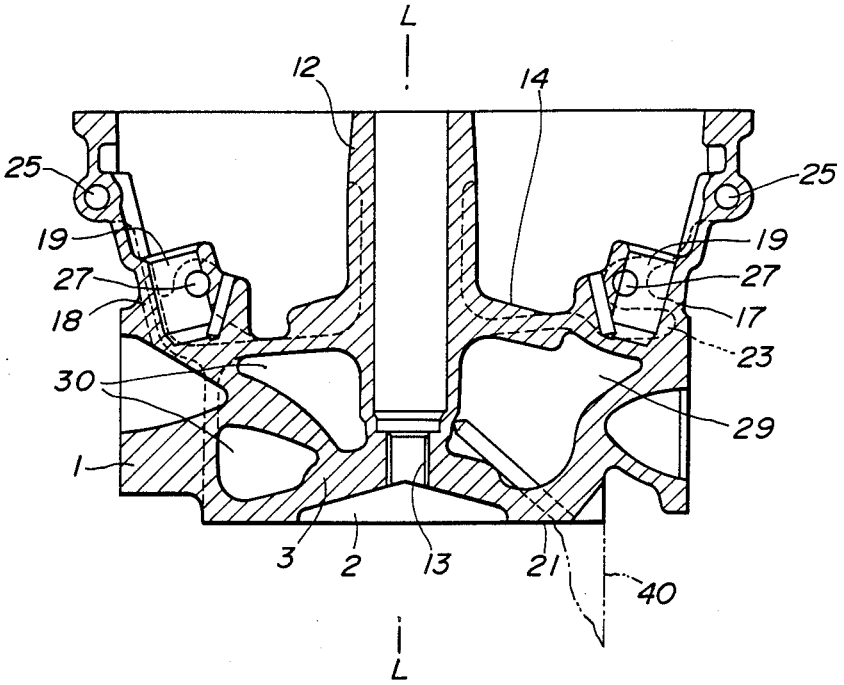
FIGS. 2 to 5 are sectional views taken along the lines II—II, III—III, IV—IV and V—V of FIG. 1, respectively.
Figure 4:
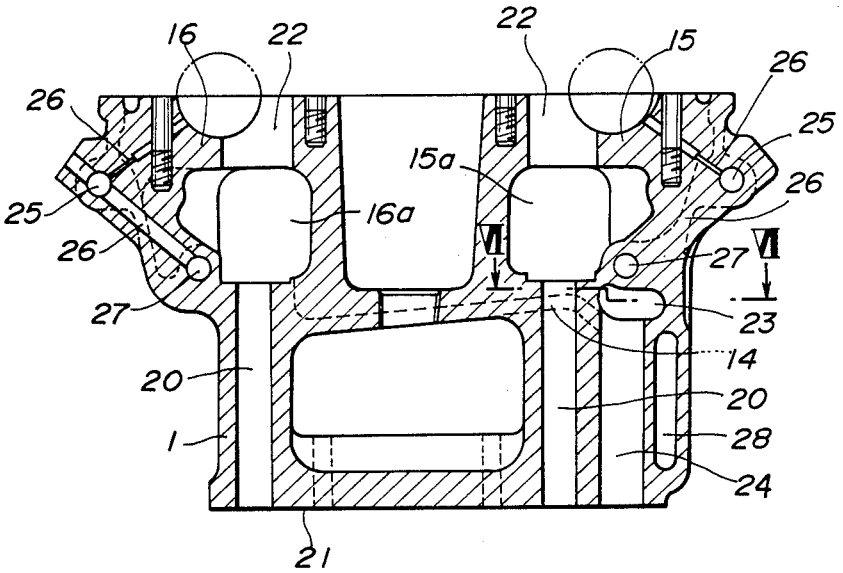
Figure 3:
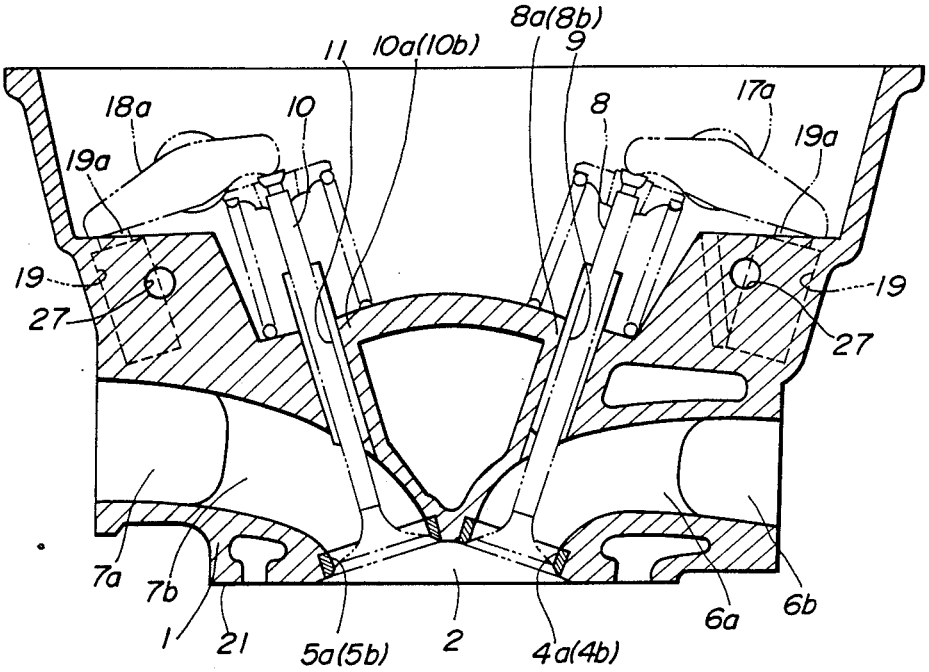
Figure 5:
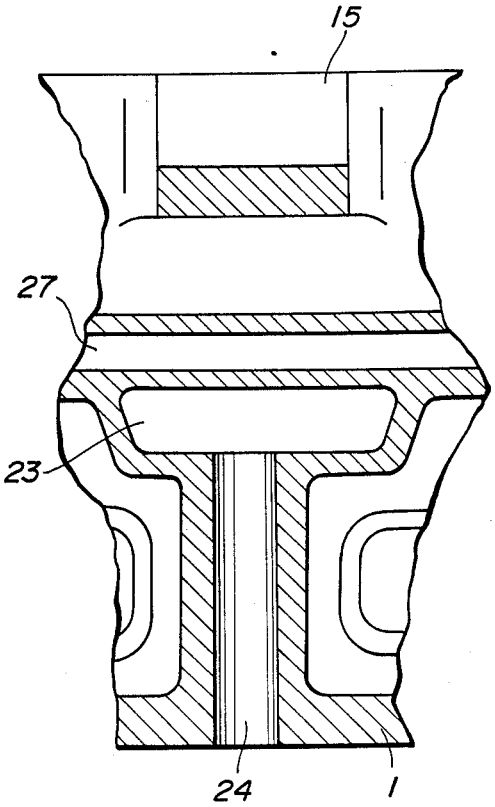
Figure 6:
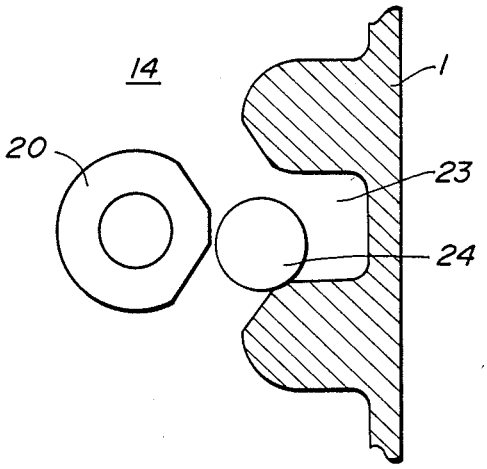
FIG. 6 is a sectional view taken along the line VI—VI of FIG. 4.

Referring to FIGS. 1 to 6, a cylinder head 1 according to an embodiment of the present invention has at a lower part thereof a plurality of combustion chambers 2 for each cylinder along a crank shaft axis K—K. The wall defining each combustion chamber 2 faces, though not shown, the top of a piston disposed in each cylinder.

The cylinder head 1 has on one side of a ceiling wall 3 of each combustion chamber 2 two intake valve openings 4*a* and 4*b* extending along the crank shaft axis K—K and on the other side two exhaust valve openings 5*a* and 5*b* extending along the crank shaft axis K—K. The intake valve openings 4*a* and 4*b* and the exhaust valve openings 5*a* and 5*b* are arranged symmetrically about the center axis L—L of the combustion chamber.

The intake valve openings 4*a* and 4*b* are respectively communicated with intake ports 6*a* and 6*b*, and the exhaust valve openings 5*a* and 5*b* are respectively communicated with exhaust ports 7*a* and 7*b*. The intake ports 6*a*, 6*b* and the exhaust ports 7*a*, 7*b* extend laterally of the cylinder head 1 so as to open to the respective lateral ends of the cylinder head, i.e., so as to form openings in the lateral end surfaces of the cylinder head 1.

The walls above each intake ports 6*a* and 6*b* are provided with valve supporting portions 8*a* and 8*b* for supporting intake valves 8 which open and close the above described intake valve openings 4*a* and 4*b*. The valve supporting portions 8*a* and 8*b* are formed with valve stem receiving openings 9. Similarly, the walls above each exhaust ports 7*a* and 7*b* are formed with valve supporting portions 10*a*, 10*b* for supporting exhaust valves 10 which open and close the above described exhaust valve openings 5*a* and 5*b*. The valve supporting portions 10*a* and 10*b* are formed with valve stem receiving openings 11.

Further, disposed at an upper central portion above each combustion chamber 2 is an annular plug receiving portion 12 concentric with the center axis L—L of the combustion chamber. The bottom wall of the plug receiving portion 12 is formed with a threaded hole 13 which opens to the combustion chamber 2. Though not shown, an ignition plug is installed in the plug receiving portion 12 by being screwed into the threaded hole 13.

The upper portion of the cylinder head 1 has at a location between an upper end of the cylinder head 1 and each combustion chamber 2 pair of bearing portions 15 and 16. The bearing potions 15 and 16 extend from the opposite lateral end portions of the cylinder head 1 toward the central portion of same and are connected at the lower ends to an upper deck 14. The upper deck 14 is located intermediate between the upper and lower ends of the cylinder head 1. The bearing portions 15 and 16 have outer peripheries of a part-circular cross section of which the center axis extends parallel with the crank shaft axis K—K, i.e., extends coaxial with respective camshaft axes M—M and N—N. Rotatably supported on the bearing portions 15 is a camshaft (not shown) for the intake valves 8, whereas rotatably supported on the bearing portions 16 is a camshaft (not shown) for the exhaust valves 10, by respectively interposing bearing caps (not shown) between the bearing portions 15, 16 and the camshafts.

Provided for each combustion chamber 2 are supporting portions 17 and 18 for rocker arms 17*a* and 18*a* at the locations more outside of the camshaft center axes M—M and N—N. The rocker arms 17*a* and 18*a* respectively engage the intake and exhaust valves 8 and 10. The supporting portions 17 and 18 are provided on the upper deck 14 in such a way as to oppose laterally of the cylinder head 1.

The rocker arms 17*a* and 18*a* are of the Y-shaped type, i.e., of the type having a Y-shaped configuration so that each rocker arm engages two valves for driving same. Each of the supporting portions 17 and 18 are therefore provided for two intake valves 8 and two exhaust valves 10 and disposed on the center line between same, i.e., disposed equidistant from the intake valves 8 and the exhaust valves 10. Further, each of the supporting portions 17 and 18 is formed with an adjustor installing opening 19 in which a hydraulic lash adjustor 19*a* is installed.

On the other hand, formed in the cylinder head in the place under each of the above described bearing portions 15 and 16 are holes 20 for accomodating therein head bolts (not shown) for securing the cylinder head 1 to a cylinder block 40. The head bolt holes 20 extend from the upper deck 14 to a lower deck 21. The bearing portions 15 and 16 are formed with access holes 22 and cavities 15*a* and 16*a* under the respective access holes 22 so that the head bolts are inserted into the head bolt holes 20 through the access holes 22 and the cavities 15*a* and 16*a*.

A thin, flat recess 23 is provided at a place laterally outside of the head bolt hole 20 in such a way as to open to the upper side of the upper deck 14 at a place adjacent the head bolt hole 20. The recess 23 opens to or is communicated with the lower side of the lower deck 21 through an oil return passage 24 arranged in parallel with the head bolt hole 20. That is, the oil return passage 24 has a lower end opening to or communicating with the lower side of the lower deck 21 and an upper end communicated with the recess 23 which is in turn communicated with the upper side of the upper deck 14.

The recess 23 and the lubrication oil return passage 24 may be provided for the respective bearing portions 15 and 16. In this instance, the recess 23 and passage 24 are provided only to the portions far apart from a camshaft drive chain chamber (not shown) located at an end portion of the cylinder head. Alternately, as shown in the present embodiments, the upper deck portion 14 routes the return oil from both of the two camshaft bearing portions 15 and 16 while a recess 23 and passage 24, provided to bearing portion 15 only, accommodates the return oil for both.

In the meantime, 25–27 are lubricating oil supply passages for conducting lubricating oil from the oil pan to the bearing portions 15 and 16 and the rocker arm supporting portions 17 and 18, and 28–30 are water jackets. The above described lubricating oil return passages 24 comunicate with the oil pan by way of the cylinder block 40.

From the foregoing, it will be understood that two intake valves and two exhaust valves for each cylinder are driven by one Y-shaped rocker arm, thus making it possible to reduce the number of constitutent parts such as rocker arms, lash adjusters, etc. Due to this, even in an internal combustion engine of the type having four valves per cylinder, the number of the rocker arm supporting portions 17 and 18 formed in the cylidner head 1 can be halved, thus making it possible to simplify the structure of the cylinder head.

It will be further understood that the number of constitutent parts as the rocker arms, etc. is reduced, thus making it possible to reduce the number of portions to be lubricated.

It will be noted that the bearing portions 15 and 16, the supporting portions 17 and 18, etc. are supplied with lubricating oil from the oil pan through the lubrication oil supply passages 25–27 formed in the cylinder head 1. The oil having lubricated various parts and portions is lead to the upper deck 14 and to the recess 23 around the head bolt holes 20. Lubricating oil is returned from the recess 23 to the oil pan through the oil return passages 24 arranged in parallel with the head bolt holes 20. By this, the lubricating oil having finished lubrication of various parts and portions does not stagnate on the upper deck 14 but is rapidly and assuredly returned to the oil pan. As a result, a good lubricating condition of the cylinder head 1 can be maintained and at the same time it becomes possible to increase the productivity of the cylinder head 1 and reduce the manufacturing cost of same.

It will be further understood that the recesses 23 are formed under the bearing portions 15 and 16 in such a way as to open to the upper surface of the upper deck 14, whereby to make it possible to eliminate a difficulty in forming the lubrication oil supply passages 25–27.

Figure 8:
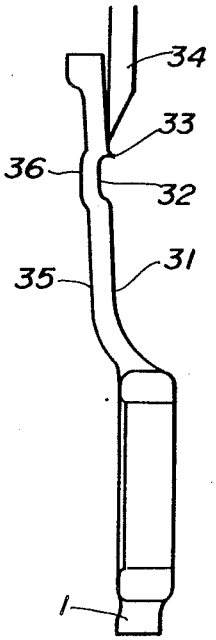
FIG. 8 is a sectional view taken along the line VIII—VIII of FIG. 7.
Figure 7:
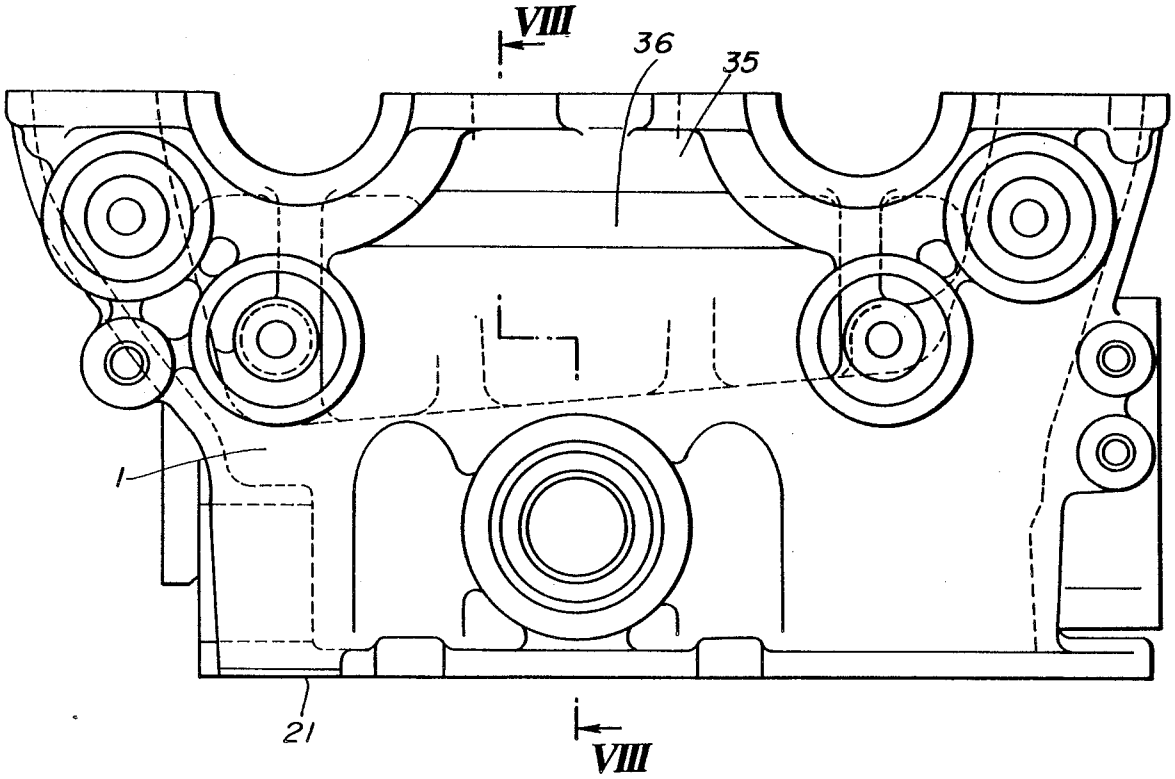
FIG. 7 is a side elevational view of the cylinder head of FIG. 1.

It will be further noted that such a cylinder head 1 can be produced by casting using upper and lower dies and a core. In casting, burrs are formed in the inner wall of the cylinder head 1 at the place corresponding to the mating surfaces of the cylinder head inner wall and the core. Such burrs are removed manually by grinding. In this connection, as shown in FIGS. 7 and 8, a groove 32 may be formed in the inner wall 31 of the cylinder head 1 in such a way as to extend along and be located inside of the mating sufaces of the upper die and the core so that burrs are produced at the end portion outside of the groove 32. By this, burrs 33 may be removed by using a cutter 34, thus making it possible to remove the burrs 33 with ease and increase the productivity of the cylinder head 1.

It will be further noted that by making the outer wall 35 of the cylinder head 1 protrude together with the provision of the groove 32, a predetermined thickness can be retained and such a protrusion 36 can serve as a rib for preventing vibrations of the outer wall 35, thus making it possible to increase the strength.

What is claimed is:

1. A cylinder head for a DOHC internal combustion engine of the type having four valves per cylinder, comprising:

a combustion chamber;

two intake valve openings and two exhaust valve openings communicating with said combustion chamber:

two intake ports and two exhaust ports communicating with said intake valve openings and said exhaust valve openings, respectively;

two first supporting portions for slidably supporting two intake valves which open and close said intake valve openings:

two second supporting portions for slidably supporting two exhaust valves which open and close said exhaust valve opening;

a plurality of bearing portions for rotatably supporting thereon two camshafts for driving said intake valves and said exhaust valves, independently;

two third supporting portions for respectively supporting Y-shaped rocker arms for driving said two intake valves and said two exhaust valves, independently;

said third supporting portions being located outside of the axes of said camshafts;

a lower deck;

a plurality of head bolt disposed holes under said bearing portions, respectively and extending through said lower deck to open to the outside of said lower deck;

an upper deck;

a plurality of recesses disposed under said bearing portions and laterally outside of upper ends of said head bolt holes, respectively and communicated with an upper side of said upper deck; and a plurality of oil return passages disposed under said bearing portions and laterally outside of and in parallel with said head bolt holes to provide communication between said recess and a lower side of said lower deck.

2. The cylinder head according to claim 1 wherein said upper deck is located intermediate between the upper and lower ends of the cylinder head.

3. The cylinder head according to claim 2 wherein said lower deck is located at the lower end of the cylinder head.

4. The cylinder head according to claim 3, further comprising oil supply passage means for allowing oil to flow down to the upper side of said upper deck after having lubricated parts and portions of the engine.

5. The cylinder head according to claim 4, further comprising a plurality of cavities under said bearing portions and a plurality of access holes formed in said bearing portions, said access holes being communicated with said head bolts holes through said cavities so that a plurality of head bolts are inserted into said head bolt holes through said access holes and said cavities.

6. The cylinder head according to claim 5 wherein said third supporting portions are respectively formed with adjuster installing openings for receiving therewithin lash adjusters for said Y-shaped rocker arms, said adjuster installing openings being arranged on a straight line which is equidistant from said two intake valves and said two exhaust valves.

7. The cylinder head according to claim 6 wherein said bearing portions comprises two bearing portions for supporting one of said camshafts for driving said intake valves and two bearing portions for supporting the other of said camshafts for driving said exhaust valves, said first mentioned two bearing portions being located outside of said first supporting portions for said intake valves and said second mentioned two bearing portions being located outside of said second supporting portions for said exhaust valves, said adjuster installing openings being equidistant from said first mentioned two bearing portions and said second mentioned bearing portions, respectively.

8. The cylinder head according to claim 7 wherein said adjuster receiving portions are located more outside of said axes of said camshafts.

9. The cylinder head according to claim 8, further comprising an annular plug receiving portion concentric with said combusiton chamber.

10. The cylinder head according to claim 8 wherein said first supporting potions and said second supporting portions are arranged symmetrically about said plug receiving sleeve portion.

* * * * *